US011592252B2

(12) United States Patent
Ytsma et al.

(10) Patent No.: US 11,592,252 B2
(45) Date of Patent: Feb. 28, 2023

(54) FIREARM SECURITY DEVICE WITH IMPROVED RETENTION POST

(71) Applicant: Blac-Rac Manufacturing, Inc., Boise, ID (US)

(72) Inventors: Cory R. Ytsma, Boise, ID (US); Eric R. Haney, Meridian, ID (US)

(73) Assignee: Blac-Rac Manufacturing, Inc., Boise, ID (US)

( * ) Notice: Subject to any disclaimer, the term of this patent is extended or adjusted under 35 U.S.C. 154(b) by 0 days.

(21) Appl. No.: 17/216,340

(22) Filed: Mar. 29, 2021

(65) Prior Publication Data

US 2022/0307785 A1 Sep. 29, 2022

(51) Int. Cl.
*F41A 17/02* (2006.01)
*F41A 23/18* (2006.01)

(52) U.S. Cl.
CPC ..... *F41A 17/02* (2013.01); *F41A 23/18* (2013.01)

(58) Field of Classification Search
CPC ..... F41A 17/00; F41A 17/02; F41A 17/46; F41A 17/54
See application file for complete search history.

(56) References Cited

U.S. PATENT DOCUMENTS 2,664,658 A * 1/1954 Bjorklund ..... F41A 17/54 42/70.07
2,742,726 A * 4/1956 Feller ..... F41A 17/54 42/70.07
3,020,663 A 2/1962 Newson
3,066,433 A * 12/1962 Rogers ..... F41A 17/54 42/70.07
3,137,957 A 6/1964 Ingalls
3,422,560 A * 1/1969 Foote ..... F41A 17/54 42/70.07
4,198,026 A * 4/1980 Capolupo ..... F41A 23/18 42/70.07
5,050,328 A * 9/1991 Insko ..... F41A 17/54 42/70.07
5,437,119 A * 8/1995 Womack ..... F41A 17/54 42/70.07

(Continued)

OTHER PUBLICATIONS

International Searching Authority; International Search Report and Written Opinion; PCT Application No. PCT/US22/22116 dated Nov. 1, 2022.

*Primary Examiner* — Joshua E Freeman
(74) *Attorney, Agent, or Firm* — Parsons Behle & Latimer

(57) ABSTRACT

A firearm security device includes a base assembly, a first plate connected to the base assembly, a retention post attached to the first plate, and a second plate. The first end of the retention post is connected to the first plate and the second end is configured to be inserted into a trigger well of a firearm. The second end includes a forward portion, a rearward portion, and a channel that separates the forward and rearward portions. The channel is configured to receive a firearm trigger. The second plate is moveable between an unlocked position and a locked position. The firearm security device includes a locking assembly that selectively locks and unlocks the second plate. The retention post is configured to transfer force away from the trigger guard and to the receiver in the event an external force is applied to a firearm locked between the plates.

20 Claims, 6 Drawing Sheets

(56) References Cited

U.S. PATENT DOCUMENTS 5,720,193 A * 2/1998 Dick ..... F41A 17/54 70/164
5,755,054 A * 5/1998 Tuller ..... F41A 17/54 42/70.07
5,918,402 A * 7/1999 Weinraub ..... F41A 17/02 42/70.07
5,918,492 A 7/1999 Klebes
6,330,815 B1 12/2001 Duncan
6,336,283 B1 * 1/2002 Ortiz ..... F41A 19/09 89/27.3
6,460,283 B1 * 10/2002 Ramos ..... F41A 17/54 42/70.07
6,474,238 B1 * 11/2002 Weinraub ..... F41A 17/54 42/70.07
6,510,640 B2 * 1/2003 Strong ..... F41A 17/54 42/70.07
7,216,449 B2 * 5/2007 Riebling ..... F41A 17/54 42/70.07
7,358,028 B2 4/2008 Maruyama et al.
8,266,835 B2 * 9/2012 Pintar ..... F41A 23/18 42/70.07
9,448,025 B2 * 9/2016 Farr ..... F41A 17/54
10,048,032 B1 * 8/2018 Lazar ..... F41A 17/44
10,139,184 B1 * 11/2018 Pintar ..... B60R 7/14
D928,902 S * 8/2021 Shiner ..... D22/108
11,231,245 B1 * 1/2022 Pintar ..... F41A 23/005
2005/0044910 A1 * 3/2005 Sloan ..... E05B 37/00 70/202
2005/0229654 A1 * 10/2005 Victor ..... E05B 73/00 70/58
2006/0117633 A1 * 6/2006 Chang ..... F41A 17/02 42/70.07
2011/0056109 A1 3/2011 Farchione et al.
2015/0033609 A1 * 2/2015 Herdman ..... F41A 17/54 42/70.07
2015/0198402 A1 * 7/2015 Brace ..... F41A 17/54 42/70.06
2016/0109203 A1 * 4/2016 Madia, II ..... F41A 17/54 42/70.07
2016/0377362 A1 * 12/2016 Farr ..... F41A 17/54 42/70.06
2018/0372446 A1 12/2018 Mack et al.
2019/0212086 A1 * 7/2019 Shiner ..... F41A 17/54
2019/0376757 A1 * 12/2019 Myers ..... F41A 23/005
2021/0325135 A1 * 10/2021 Eckelkamp ..... F41A 17/54

* cited by examiner

FIREARM SECURITY DEVICE WITH IMPROVED RETENTION POST

FIELD OF THE THE DISCLOSURE

The examples described herein relate to apparatus, systems, and methods for an improved retention post and a firearm arm security device that utilizes the improved retention post.

BACKGROUND

Description of the Related Art

Various devices may be used to secure a firearm. U.S. Pat. Nos. 7,658,028 and 8,266,835, both of which are incorporated in reference in their entireties, disclose examples of a firearm security devices that may be used to secure a firearm. In some instances, the effectiveness of a firearm security device may be limited to a weakness in the design of a firearm arm. For example, a firearm security device may be used to secure a firearm, such as but not limited to, an ArmaLite model 15 (AR15) firearm, or the like. An AR15 firearm includes a trigger guard, which is a structure that is pinned to the lower receiver adjacent to the trigger. The trigger guard may be made of a material that is not a strong as the receiver. For example, the trigger guard may be a plastic or a composite material, which is weaker than the lower receiver, which is typically formed of a metal such as aluminum or the like. The potential weakness of the trigger guard may be used to remove a firearm locked in a firearm security device without unlocking the firearm security device. In some instances, it may be possible to apply a force to a firearm locked in a firearm security device and due to some play (i.e., looseness) the firearm may be able to shift about a short distance within the firearm security device. Repeated exertion of force on a locked firearm such as repeatedly moving the firearm back and forth a sort distance within the firearm security device may result in breaking the weaker trigger guard permitting the firearm to be removed from the firearm security device without actually unlocking the device. Other disadvantages may exist.

SUMMARY

The present disclosure is directed to apparatus, systems, and methods for an improved retention post and a firearm security device that includes the improved retention post.

One embodiment of the disclosure is a firearm security device. The firearm security device comprises a base assembly and a first plate connected to the base assembly. The firearm security device includes a retention post having a first end and a second end opposite the first end. The first end of the retention post is attached to the first plate. The second end of the retention post is configured to be inserted into a trigger well of a firearm. The second end of the retention post includes a forward portion and a rearward portion with a channel in the second end that separates the forward portion from the rearward portion. The channel is configured to receive a trigger of a firearm.

The firearm security device includes a second plate connected to the base assembly. The second plate is moveable between an unlocked position and a locked position. In the unlocked position the first plate and second plate are separated by a first distance and in the locked positioned the first plate and the second plate are separate by a second distance that is less than the first distance. The firearm security device includes a locking assembly that selectively locks the second plate in the locked position and selectively unlocks the second plate to enable the second plate to move to the unlocked positioned from the locked position.

The channel of the firearm security device may include a flat bottom, a flat front side, and a curved back side. The retention post may include an aperture locate in the forward portion that extends from the first end of the retention post to the second end of the retention post. The firearm security device may include a fastener positioned in the aperture to connect the retention post to the first plate. The forward portion of the retention post may have a first perimeter shape that includes a first flat side, a second flat side and an arc between the first flat side and the second flat side. The forward portion of the retention post may include a first outer bevel. The first perimeter shape may be configured to substantially conform with a forward portion of a firearm receiver and a forward portion of a trigger guard of a firearm.

The rearward portion of the retention post may have a second perimeter shape comprised of an arc. The rearward portion of the retention post may include a second outer bevel. The second perimeter may be configured to substantially conform with a rearward portion of a firearm receiver and a rearward portion of a trigger guard of a firearm. The retention post may be made of stainless steel. The firearm security device may include a support member connected to the first plate with the support member being a projection that extends from the first plate toward the second plate.

One embodiment of the present disclosure is a retention post. The retention post comprises a member having a first end and a second end opposite the first end. The second end of the member comprising a forward portion and a rearward potion. The retention post includes a channel in the second end of the member that separates the forward portion of the second end from the rearward portion of the second end. The channel has a flat bottom, a flat forward side adjacent to the forward portion of the second end, and a curved rear side adjacent to the rearward portion of the second end. The retention post includes an aperture that extends through the forward portion from the first end to the second end.

The forward portion of the retention post may have a first perimeter shape that is configured to substantially fill a trigger well of a firearm forward of a trigger. The first perimeter shape may include a first flat side, a second flat side, and an arc between the first flat side and the second flat side. The rearward portion of the retention post may have a second perimeter shape that is configured to substantial fill a trigger well of a firearm rearward of a trigger. The second perimeter shape may be an arc.

One embodiment of the disclosure is a method for securing a firearm. The method includes inserting a firearm in between a first plate and a second plate. The method comprises positioning a retention post in a trigger well of the firearm defined by a receiver and a trigger guard of the firearm, the retention post having a forward portion and a rearward portion, wherein the forward portion substantially fills the trigger well forward of a trigger and the rearward portion substantially fills the trigger well rearward of the trigger. The method includes moving the first plate and second plate together to a locked position. The method includes selectively locking the first plate and second plate in the locked position. The method comprises transferring a force away from the trigger guard and to the receiver of the firearm with the retention post when an external force is applied to the firearm with the first plate and second plate in the locked position.

The method may include positioning the trigger in a channel in the retention post, the channel separating the forward portion from the rearward portion. The method may include connecting the retention post to the first plate via a fastener positioned in an aperture through the forward portion of the retention post.

Figure 1A:
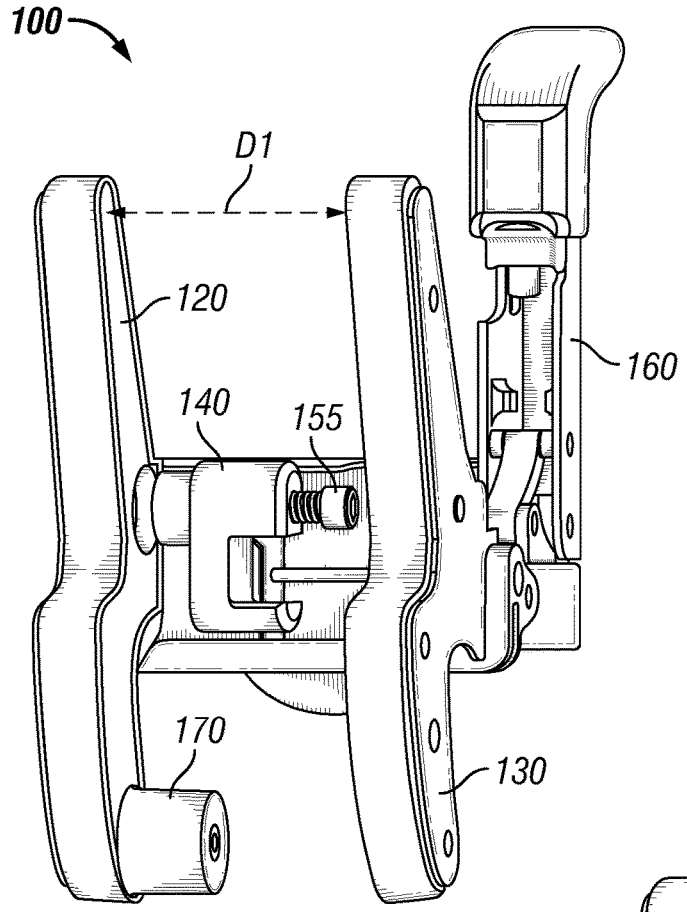
FIG. 1A is a perspective view of a firearm security device in an unlocked position.

While the disclosure is susceptible to various modifications and alternative forms, specific examples have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

In this disclosure, numerous specific details are discussed to provide a thorough and enabling description for embodiments of the present disclosure. One of ordinary skill in the art will recognize that the disclosure can be practiced without one or more of the specific details. Well-known structures and/or operations often associated with retention posts and firearm security devices may not be shown and/or may not be described in detail to avoid obscuring other aspects of the disclosure. In general, it should be understood that various other devices, systems, and/or methods in addition to those specific embodiments disclosed herein may be within the scope of the present disclosure.

As used herein, the terms "vertical," "lateral," "upper," and "lower" can refer to relative directions or positions of features in the retention post and/or firearm security systems shown in the Figures. For example, "upper" or "uppermost" can refer to a feature positioned closer to the top of a page than another feature. These terms, however, should be construed broadly to include retention ports and/or firearm security devices having other orientations, such as inverted or inclined orientations where top/bottom, over/under, above/below, up/down, and left/right can be interchanged depending on the orientation.

Figure 1B:
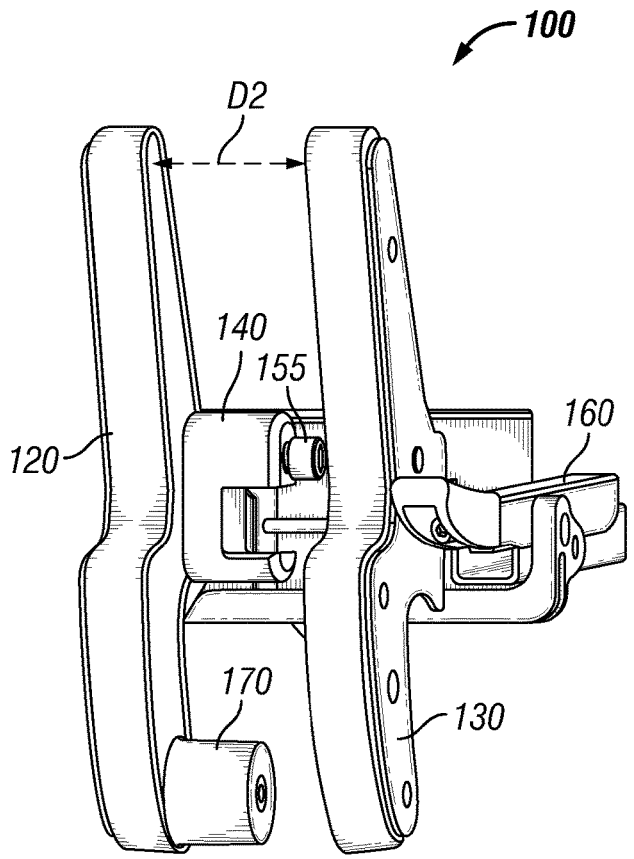
FIG. 1B is a perspective view of a firearm security device in a locked position.

FIG. 1A is a perspective view of a firearm security device 100 in an unlocked position. FIG. 1B is a perspective view of the firearm security device 100 in a locked position. The firearm security device 100 may include a first plate 120 and a second plate 130 connected to a base member 110. A locking member 160 may be used to lock the first and second plates 120, 130 in a locked position as discussed herein. The locking member 160 may be a locking assembly as known in the art.

A retention post 140 may be connected to the first plate 120. The first plate 120 may include a support member 170 that projects from the first plate 120 to the second plate 130. The retention post 140 may be configured to insert into the trigger well of a firearm and retains the firearm within the firearm security device 100 in conjunction with the first and second plates 120, 130 as discussed herein. The support member 170 may aid in supporting a firearm positioned within the firearm security device 100. The support member 170 may be integral to the first plate 120 or may alternatively be connected to the first plate 120.

Figure 4:
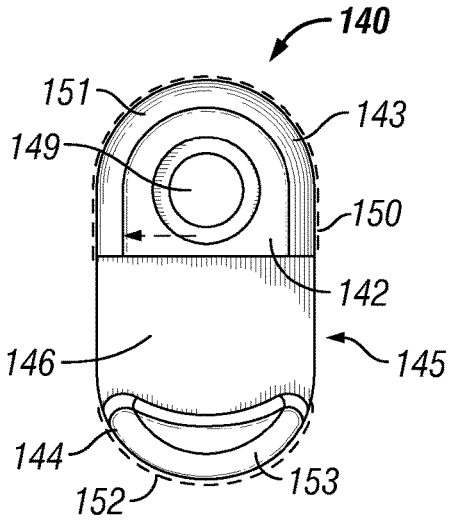
FIG. 4 is an end view of an embodiment of a retention post.
Figure 5:
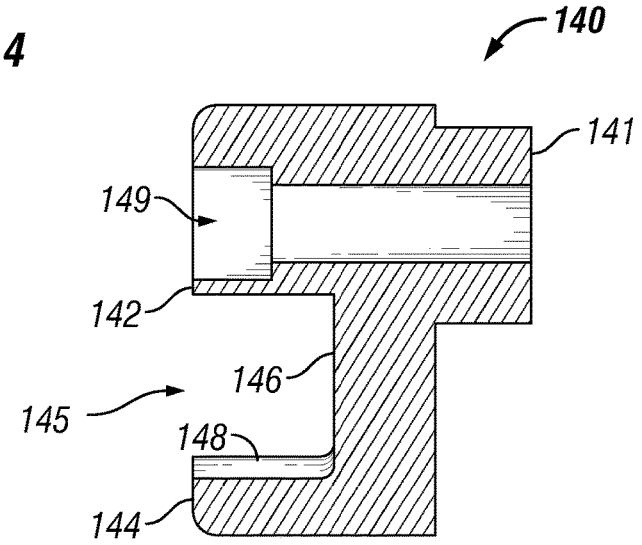
FIG. 5 is a cross-sectional view of an embodiment of a retention post.
Figure 6:
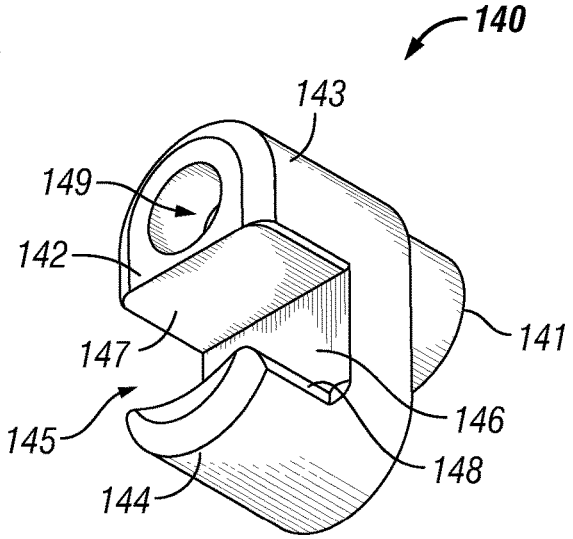
FIG. 6 is a perspective view of an embodiment of a retention post.

The retention post 140 may be connected to the first plate 120 via a fastener 155 positioned in an aperture 149 (best shown in FIGS. 4-6) through the retention post 140. The retention post 140 may be configured to be inserted into the trigger well of a firearm. The trigger well as used herein is the open space where the trigger is located that is between the receiver and the trigger guard of a firearm. For example, the trigger well for an AR15 is the opening on the lower receiver at which the trigger is located and that is defined by the lower receiver and the trigger guard pinned to the lower receiver across the opening.

Referring to FIGS. 3-6, the retention post 140 includes a first end 141 and a second end 142 opposite of the first end 141. The first end 141 of the retention post 140 may be connected to the first plate 120. The second end 142 of the retention post 140 includes a forward portion 143 and a rearward portion 144 with a channel 145 separating the forward portion 143 from the rearward portion 144. The channel 145 is configured to receive the trigger of a firearm. The channel 145 has a flat front side 147, a flat bottom 146, and a curved rear side 148. The retention post 140 includes an aperture 149 through the forward portion 143. The aperture 149 extends from the first end 141 to the second end 142 and a fastener 155 (shown in FIG. 1A) may be inserted through the aperture 149 to secure the retention post 140 to the first plate 120.

The forward portion 143 of the retention post 140 includes a first perimeter shape 150 that is configured to substantially fill the space of a trigger well forward of a trigger when the retention post 140 is inserted into the trigger well of a firearm. The first perimeter shape 150 includes a first flat side, a second flat side, and an arc between the first flat side and the second flat side. The forward portion 143 may include a first outer bevel 151. The rearward portion 144 of the retention post 140 includes a second perimeter shape 152 that is configured to substantially fill the space of a trigger well rearward of a trigger when the retention post 140 is inserted into the trigger well of a firearm. The second perimeter shape 152 is an arc. The rearward portion 144 may include a second outer bevel 153. The forward portion 143, the rearward portion 144, and the channel 145 are configured to retain the trigger of a firearm while transferring force toward the receiver of a firearm away from the trigger guard when an external force is applied to a firearm secured in a firearm security device 100 using the retention post 140. The retention post 140 may be comprised of various metals. For example, the retention post 140 may be comprised of stainless steel, or the like. In one embodiment, the retention post 140 may be made machined from a solid billet of 304 stainless steel.

The second plate 130 of the firearm security device 100 is movable with respect to the first plate 120. In the unlocked position, the first and second plates 120, 130 are positioned apart a first distance D1. The first distance D1 enables a firearm, such as but not limited to an AR15, to be positioned between the first and second plates 120, 130. In the locked position, the first and second plates 120, 130 are positioned apart a second distance D2. In the locked position, the first and second plates 120, 130 as well as the retention post 140 are configured to secure a firearm within the firearm security device 100. The locking member 160 may be used to selectively lock a firearm within the firearm security device 100 in various ways as would be appreciated by one of ordinary skill in the art having the benefit of this disclosure. For example, the movement of the locking member 160 may be used to move the second plate 130 toward the first plate 120 as shown in FIG. 1B. The locking member 160 may require a key to enable the locking member 160 to be moved back to an unlocked position enabling the second plate 130 to move away from the first plate 120 to an unlocked position.

Figure 2:
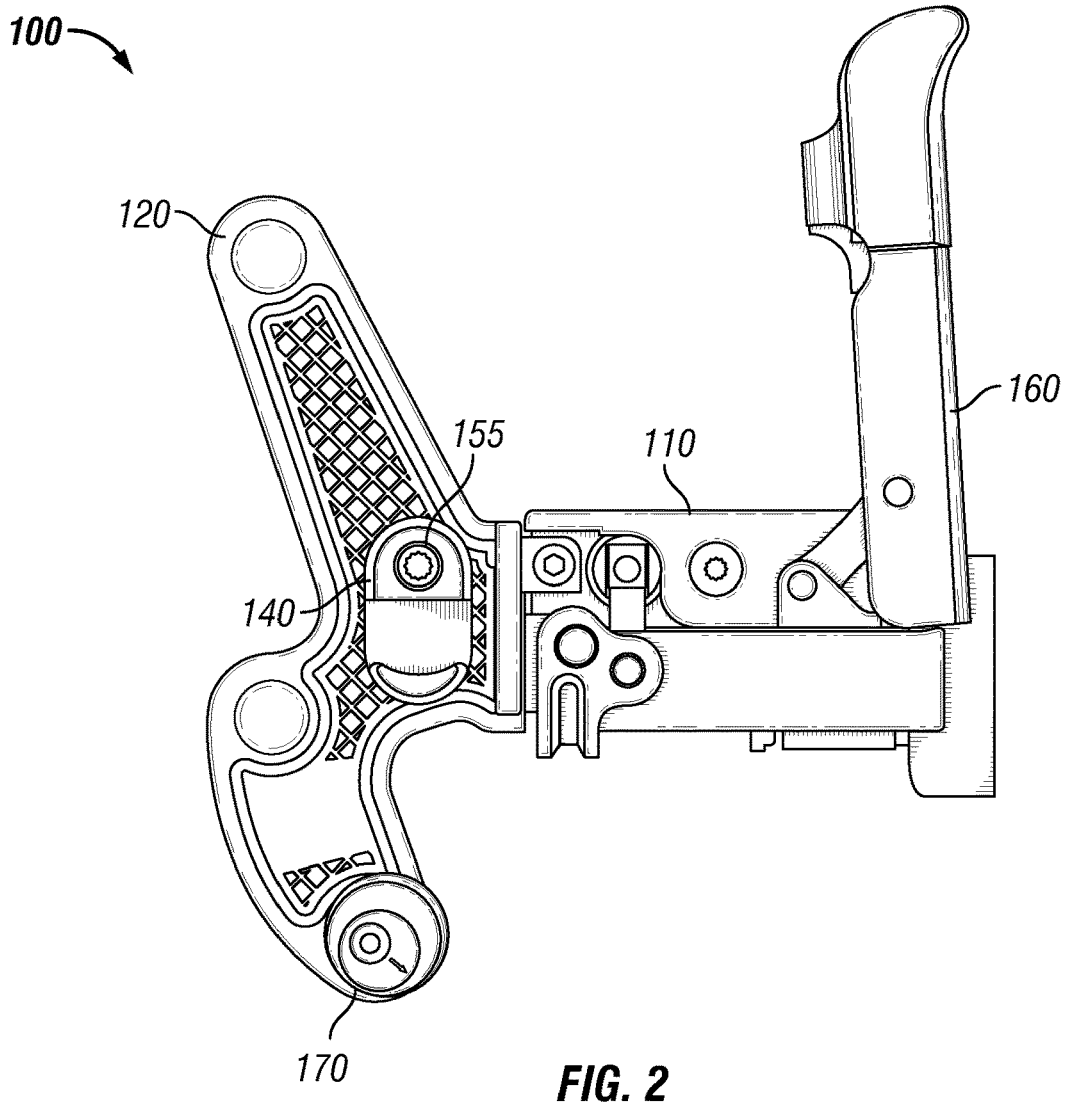
FIG. 2 is a side view of a firearm security device.
Figure 3:
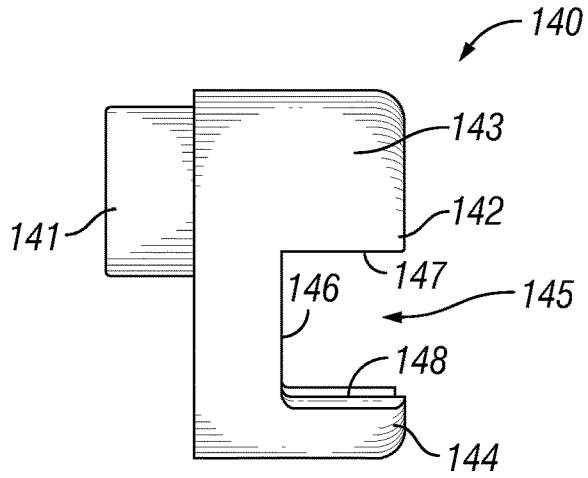
FIG. 3 is a side view of an embodiment of a retention post.

FIG. 2 is a side view of a firearm security device 100 with the second plate 130 removed for clarity. The retention post 140 is connected to the first plate 120 via the fastener 155 position in the aperture 149 through the forward portion 143 of the retention post 140. Alternatively, the retention post 140 could be connected to the second plate 130 as would be appreciated by one of ordinary skill in the art having the benefit of this disclosure. Movement of the locking member 160 moves the second plate 130 toward the first plate 120 to a locked position (shown in FIG. 1B) to selectively secure a firearm within the firearm security device 100. Likewise, the movement of the locking member 160 could move the first plate 120 with respect to the second plate 130 to selectively secure a firearm within the firearm security device 100 as would be appreciated by one of ordinary skill in the art having the benefit of this disclosure.

Figure 7:
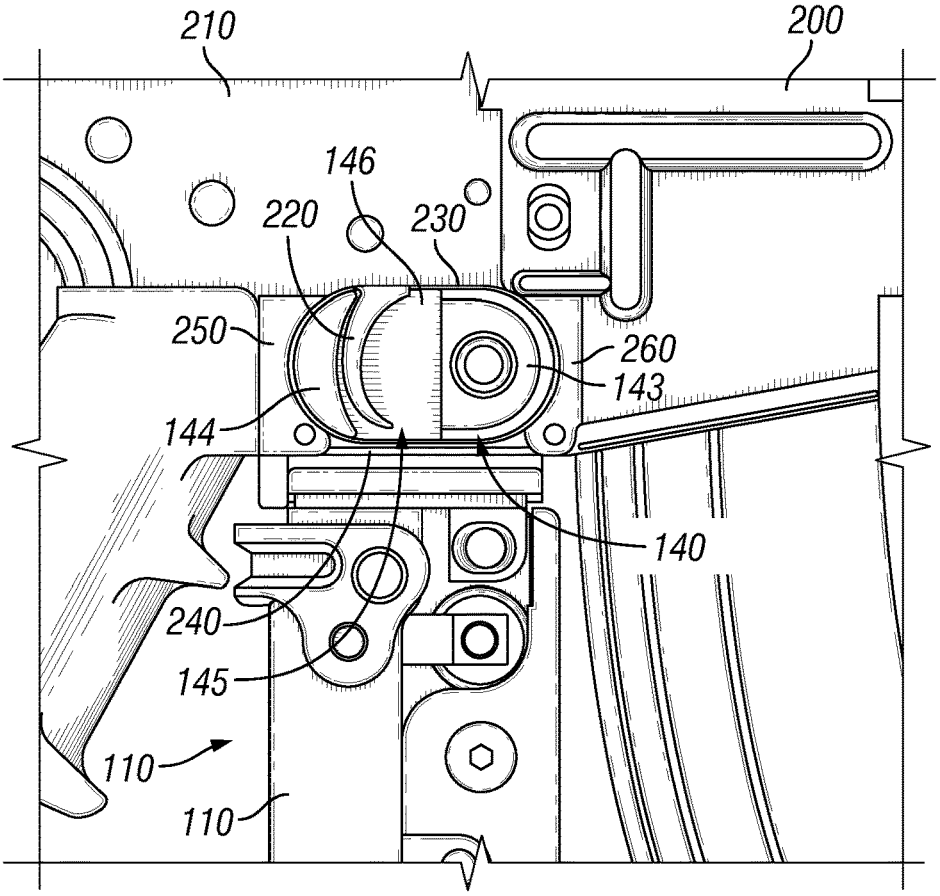
FIG. 7 is a schematic of a firearm positioned within a firearm security device.

FIG. 7 is a schematic of a firearm 200 positioned within a firearm security device 100. The second plate 130 of the firearm security device 100 has been removed for clarity. The firearm 200 includes a receiver 210, or lower receiver, with a trigger 220 position within a trigger well 230. The trigger well 230 is defined by the receiver 210, a forward portion 260 of the receiver 210, a rearward portion 250 of the receiver 210, and a trigger guard 240. The retention post 140 of the firearm security device 100 is inserted into the trigger well 230 of the firearm 200. As shown in FIG. 7, the forward portion 143 of the retention post 140 substantially fills the trigger well 230 forward of the trigger 220. Likewise, the first perimeter shape 150 of the forward portion 143 of the retention post 140 is configured to substantially conform to the shape of the forward portion 260 of the receiver 210 as well as a portion of the trigger guard 240 both being positioned adjacent to the forward portion 143 of the retention post 140.

The rearward portion 144 of the retention post 140 substantially fills the trigger well 230 rearward of the trigger 220. Likewise, the second perimeter shape 152 of the rearward portion 144 of the retention post 140 is configured to substantially conform to the shape of the rearward portion 250 of the receiver 210 positioned adjacent to the rearward portion 144 of the retention post 140. The trigger 220 of the firearm 200 is positioned within the channel 145 of the retention post 140. The forward portion 143, rearward portion 144, and channel 145 prevent the accidental discharge of the firearm 200 in the event that the firearm 200 was secured within the firearm security device 100 with a round located within the firing chamber of the firearm 200. The retention post 140 reduces, if not eliminates, the ability to move the firearm back and forth a short distance within the firearm security device 100 by substantially filling up the trigger well 230.

Figure 8:
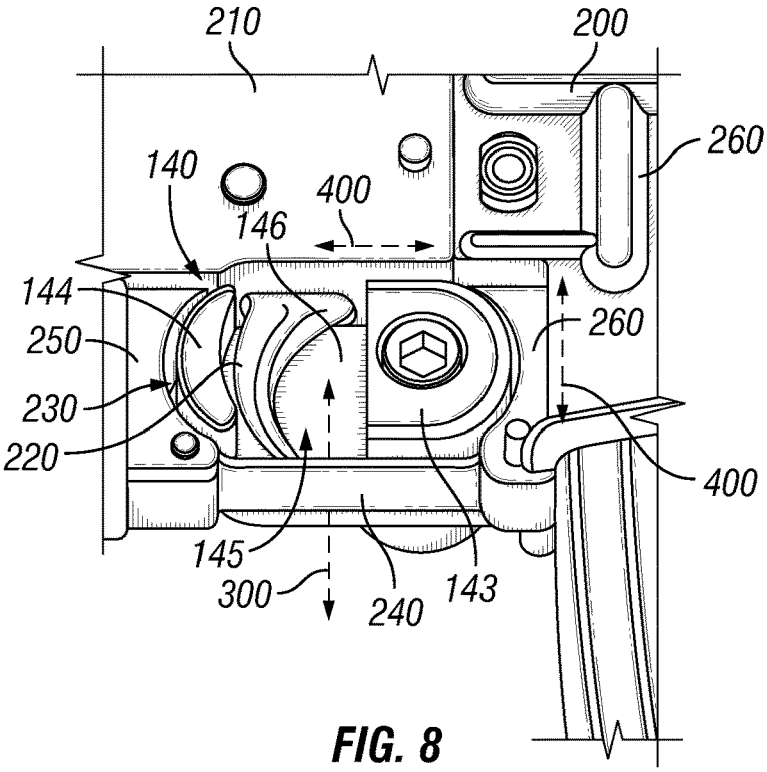
FIG. 8 is a schematic of a firearm positioned within a firearm security device.

FIG. 8 is a schematic of a firearm 200 positioned within a firearm security device 100 showing only the retention post 140 of the firearm security device 100 for clarity. While the firearm 200 is secured within the firearm security device 100 an external force, shown by arrow 300, may be applied to the firearm 200. The external force 300 may be a repeated force applied to the firearm 200 in an attempt to extract the firearm 200 from the locked firearm security device 100. As the forward and rearward portions 143, 144 substantially fill the trigger well 230 forward and rearward of the trigger 220 in addition to the perimeter shape of the forward and rearward portions 143, 144, the retention post 140 transfers force, shown by arrows 400, towards the receiver 210 and away from the trigger guard 240. The transfer of force to the receiver 210 away from the trigger guard 240 decreases the chance that the trigger guard 240 may break enabling the firearm 200 to be removed from the firearm security device 100. Additionally, the channel 145 and forward and rearward portions 143, 144 of the retention post 140 prevent the trigger from being actuated due to applied external force 300. The arrows 300, 400 are for illustrative purposes and are not drawn to scale and the orientation, and/or direction may vary.

Figure 9:
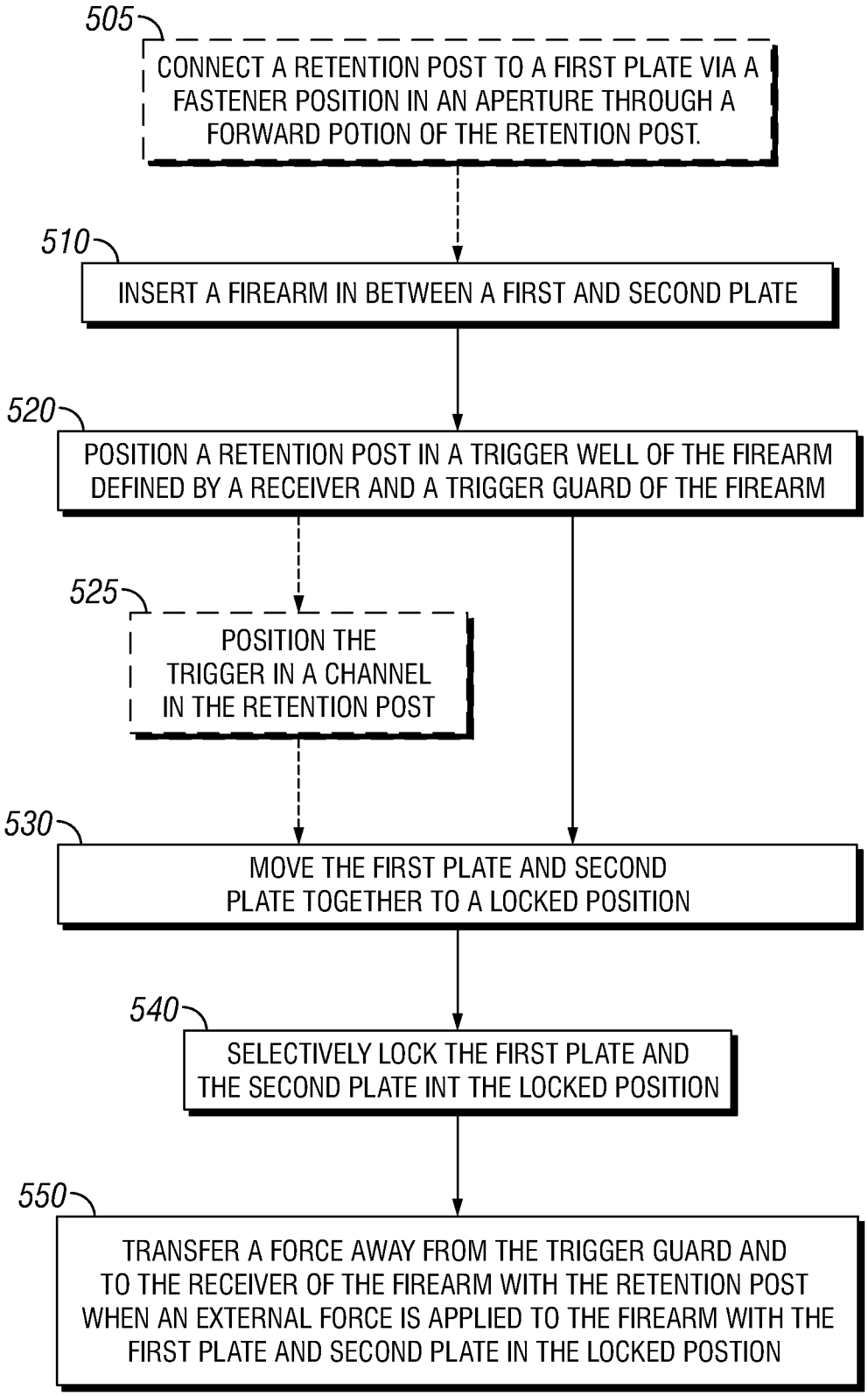
FIG. 9 is a flow chart of an embodiment of a method for securing a firearm.

FIG. 9 is a flow chart of an embodiment of a method 500 for securing a firearm 200. The method 500 includes inserting a firearm in between a first plate and a second plate, at 510. Optionally, the method 500 may include connecting a retention post to a first plate via a fastener positioned in an aperture through a forward portion of the retention post, at 505. Various mechanism may be used to connect the retention post to the first plate as would be appreciated by one of ordinary skill in the art having the benefit of this disclosure. For example, the retention may be, but is not limited to, welded to the first plate or may be an integral part of the first plate. The method 500 includes positioning a retention post in a trigger well of the firearm with the trigger well being defined by a receiver and a trigger guard of the firearm, at 520. Optionally, the method 500 may include positioning the trigger of the firearm in a channel in the retention post, at 525.

The method 500 includes moving the first plate and the second late together to a locked position, at 530. The method 500 includes selectively locking the first plate and the second plate in the locked position, at 540. Steps 530 and 540 may be done concurrently as would be appreciated by one of ordinary skill in the art having the benefit of this disclosure. The method 500 includes transferring a force away from the trigger guard and to the receiver of the firearm with the retention post when an external force is applied to the firearm with the first plate and the second plate in the locked position, at 550.

Figure 10:
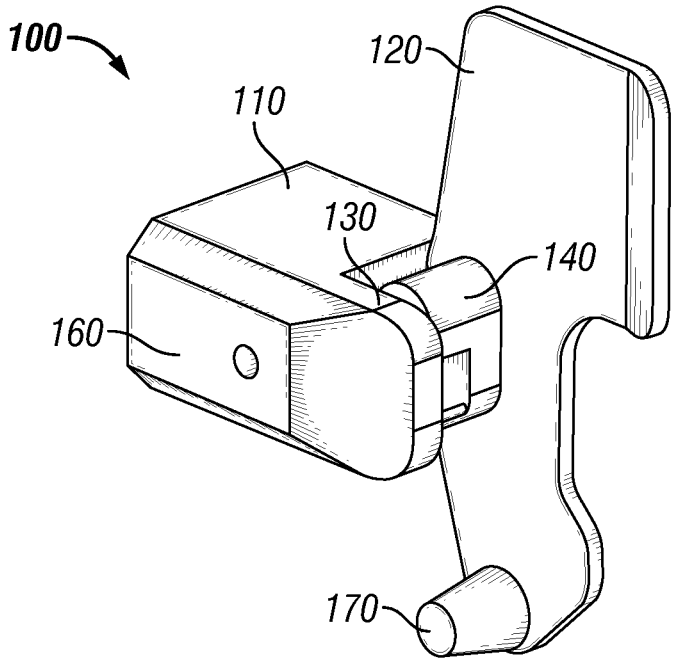
FIG. 10 is a perspective view of a firearm security device in a locked position.
Figure 11:
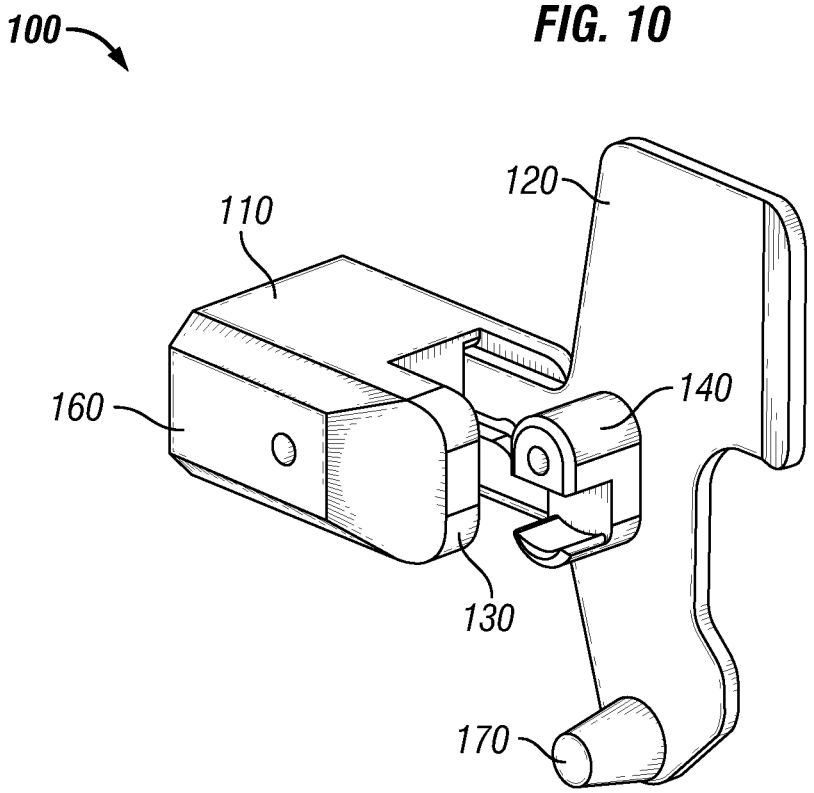
FIG. 11 is a perspective view of a firearm security device in an unlocked position.

FIG. 10 is a perspective view of a firearm security device 100 in an unlocked position and FIG. 11 is a perspective view of the firearm security device 100 in a locked position. The firearm security device 100 may include a first plate 120 connected to a base member 110. The firearm security device 100 includes a second plate 130 that is integral with the base member 110. A locking member 160 may be used to lock the first and second plates 120, 130 in a locked position as discussed herein. The locking member 160 may be a locking assembly as known in the art.

The firearm security device 100 includes a retention post 140 connected to the first plate 120 with the retention post 140 configured to be inserted into the trigger well of a firearm as discussed herein. The firearm security device 100 is configured to move the first and second plates 120. 130 with respect to each other. In the unlocked position, the first and second plates 120, 130 are positioned apart a greater distance than in the closed positioned. A firearm, such as but not limited to an AR15, may be positioned between the first and second plates 120, 130 when in the unlocked positioned. In the locked position, the first and second plates 120, 130 as well as the retention post 140 are configured to secure a firearm within the firearm security device 100. The locking member 160 may be used to selectively lock a firearm within the firearm security device 100 in various ways as would be appreciated by one of ordinary skill in the art having the benefit of this disclosure.

Although this disclosure has been described in terms of certain examples, other examples that are apparent to those of ordinary skill in the art, including examples that do not provide all of the features and advantages set forth herein, are also within the scope of this disclosure. Accordingly, the scope of the present disclosure is defined only by reference to the appended claims and equivalents thereof.

What is claimed is:

1. A firearm security device comprising:

a base assembly;

a first plate connected to the base assembly;

a retention post having a first end and a second end opposite the first end, the first end being attached to the first plate and the second end being configured to insert into a trigger well of a firearm, the second end having a forward portion and a rearward portion with a channel in the second end that separates the forward portion from the rearward portion, the channel configured to receive a trigger of a firearm;

a second plate connected to the base assembly, the second plate is moveable between an unlocked position and a locked position, wherein in the unlocked position the first plate and second plate are separated by a first distance and in the locked positioned the first plate and the second plate are separate by a second distance that is less than the first distance;

a locking assembly, the locking assembly selectively locks the second plate in the locked position and selectively unlocks the second plate to enable the second plate to move to the unlocked positioned from the locked position;

wherein the channel comprises a flat bottom, a flat front side, and a curved back side; and an aperture located in the forward portion of the retention post that extends from the first end of the retention post to the second end of the retention post.

2. The firearm security device of claim 1, comprising a fastener positioned in the aperture to connect the retention post to the first plate.

3. The firearm security device of claim 1, the forward portion of the retention post having a first perimeter shape comprising a first flat side, a second flat side, and an arc between the first flat side and the second flat side.

4. The firearm security device of claim 3, the forward portion of the retention post comprises a first outer bevel.

5. The firearm security device of claim 3, wherein the first perimeter shape is configured to substantially conform with a forward portion of a firearm receiver and a forward portion of a trigger guard of a firearm.

6. The firearm security device of claim 5, the rearward portion of the retention post having a second perimeter shape comprised of an arc.

7. The firearm security device of claim 6, the rearward portion of the retention post comprises a second outer bevel.

8. The firearm security device of claim 6, wherein the second perimeter is configured to substantially conform with a rearward portion of a firearm receiver and a rearward portion of a trigger guard of a firearm.

9. The firearm security device of claim 8, wherein the retention post is comprised of stainless steel.

10. The firearm security device of claim 9, comprising further a support member connected to the first plate, the support member being a projection that extends from the first plate towards the second plate.

11. A method for securing a firearm comprising:

inserting a firearm in between a first plate and a second plate;

positioning a retention post in a trigger well of the firearm defined by a receiver and a trigger guard of the firearm, the retention post having a forward portion and a rearward portion, wherein the forward portion substantially fills the trigger well forward of a trigger and the rearward portion substantially fills the trigger well rearward of the trigger;

moving the first plate and second plate together to a locked position;

selectively locking the first plate and second plate in the locked position; and transferring a force away from the trigger guard and to the receiver of the firearm with the retention post when an external force is applied to the firearm with the first plate and second plate in the locked position.

12. The method of claim 11, further comprising positioning the trigger in a channel in the retention post, the channel separating the forward portion from the rearward portion.

13. The method of claim 12, connecting the retention post to the first plate via a fastener positioned in an aperture through the forward portion of the retention post.

14. A firearm security device comprising:

a base assembly;

a first plate connected to the base assembly;

a retention post having a first end and a second end opposite the first end, the first end being attached to the first plate and the second end being configured to insert into a trigger well of a firearm, the second end having a forward portion and a rearward portion with a channel in the second end that separates the forward portion from the rearward portion, the channel configured to receive a trigger of a firearm;

a second plate is moveable between an unlocked position and a locked position, wherein the second plate is connected to the base assembly in both the locked positioned and the unlocked position and wherein in the unlocked position the first plate and second plate are separated by a first distance and in the locked positioned the first plate and the second plate are separate by a second distance that is less than the first distance; and a locking assembly, the locking assembly selectively locks the second plate in the locked position and selectively unlocks the second plate to enable the second plate to move to the unlocked positioned from the locked position.

15. The firearm security device of claim 14, further comprising an aperture located in the forward portion of the retention post that extends from the first end of the retention post to the second end of the retention post.

16. The firearm security device of claim 15, comprising a fastener positioned in the aperture to connect the retention post to the first plate.

17. The firearm security device of claim 14, the forward portion of the retention post having a first perimeter shape comprising a first flat side, a second flat side, and an arc between the first flat side and the second flat side.

18. The firearm security device of claim 17, the forward portion of the retention post comprises a first outer bevel.

19. The firearm security device of claim 17, wherein the first perimeter shape is configured to substantially conform with a forward portion of a firearm receiver and a forward portion of a trigger guard of a firearm.

20. The firearm security device of claim 19, the rearward portion of the retention post having a second perimeter shape comprised of an arc.

* * * * *